US005623795A

United States Patent [19]

Padgett, Jr.

[11] Patent Number: 5,623,795

[45] Date of Patent: Apr. 29, 1997

[54] DRAFT INSULATOR FOR AN ATTIC PULL-DOWN STAIRCASE

[76] Inventor: Herman M. Padgett, Jr., 201 Westside Dr., Lexington, S.C. 29072

[21] Appl. No.: 658,349

[22] Filed: Jun. 5, 1996

[51] Int. Cl.[6] ..... E04F 11/04

[52] U.S. Cl. ..... 52/202; 52/186; 52/404.1; 182/47; 182/77; 49/463

[58] Field of Search ..... 52/404.1, 19, 186, 52/202; 182/46, 47, 77, 78, 79, 80, 81; 49/463, 466

[56] References Cited

U.S. PATENT DOCUMENTS

| | | | |
|---|---|---|---|
| 3,566,566 | 3/1971 | Janic | 49/463 X |
| 4,079,558 | 3/1978 | Gorham . | |
| 4,125,982 | 11/1978 | Ward | 52/404.1 |
| 4,151,894 | 5/1979 | Edwards . | |
| 4,281,743 | 8/1981 | Fuller . | |
| 4,312,423 | 1/1982 | Helbig . | |
| 4,337,602 | 7/1982 | King . | |
| 4,344,505 | 8/1982 | Waters et al. . | |
| 4,387,541 | 6/1983 | Bommershine . | |
| 4,541,208 | 9/1985 | Vesperman et al. . | |
| 4,550,534 | 11/1985 | Mariano et al. . | |
| 4,567,697 | 2/1986 | Hahne | 49/465 X |
| 4,591,022 | 5/1986 | Sciambi et al. . | |
| 4,658,555 | 4/1987 | Steiner . | |
| 4,832,153 | 5/1989 | Daw et al. . | |
| 4,928,441 | 5/1990 | Daley . | |
| 4,944,126 | 7/1990 | King | 182/47 X |
| 5,220,757 | 6/1993 | Hulligan . | |
| 5,271,198 | 12/1993 | Freeman | 52/202 |
| 5,457,922 | 10/1995 | Fara | 52/202 |
| 5,475,955 | 12/1995 | Dickinson | 52/186 X |

FOREIGN PATENT DOCUMENTS

| | | | |
|---|---|---|---|
| 2830317 | 1/1980 | Germany | 182/46 |
| 3637493 | 5/1988 | Germany | 52/19 |

OTHER PUBLICATIONS

Doty, Roy, "Wordless Workshop", Popular Science.

*Primary Examiner*—Carl D. Friedman
*Assistant Examiner*—Laura A. Saladino
*Attorney, Agent, or Firm*—Michael A. Mann, P.A.

[57] ABSTRACT

A draft insulator kit for use with an attic pull-down staircase comprises a dimensioned enclosure held together with plastic rivets and resting on weather stripping placed directly on the framing around the pull-down staircase. The edge of the box rests on the weather stripping to seal against drafts. The insulator can be covered with fiberglass batting to increase R value but is itself a cost-effective seal against drafts. It can be folded for increased shipping efficiency, is made of low cost cardboard, and has low manufacturing costs. As a result, its payback time to the consumer is less than one season.

18 Claims, 2 Drawing Sheets

DRAFT INSULATOR FOR AN ATTIC PULL-DOWN STAIRCASE

BACKGROUND OF THE INVENTION

1. Field of the Invention:

The invention relates generally to attic insulation and more particularly to a covering for a pull-down staircase to prevent drafts and provide thermal insulation over the staircase without interfering with the operation of the staircase itself. The present application claims the benefit of provisional application U. S. Ser. No. 60/005,806 filed Oct. 23, 1995.

2. Discussion of Background:

The importance of energy conservation was underscored in the 1970's when the price of oil and related fuels increased dramatically. As a consequence, many homeowners made changes to the way they used energy in their homes, and new homes were built with greater emphasis on energy usage. Turning down a thermostat in winter and up in summer, adding insulation to ceilings and walls and installing better windows make a big difference in energy consumption for space heating and cooling. After these three measures, however, it becomes more and more difficult to reduce energy consumption economically without increasing discomfort for those who occupy the space.

Additional energy savings can be obtained, of course, but often only with a financial investment that rivals the reduced energy costs. In some cases, the homeowner must wait a number of years to be paid back for that investment by those lowered energy bills. In a few cases, it is better to forego, at least for a time, the installation of energy saving equipment. For example, more efficient appliances can be installed, but it is often diseconomic to do so before the appliances in the home have approached their full, useful life. Thus, the "payback time" or the time that is required for a homeowner to use a product that saves energy before he can recoup his investment in that product is a factor in deciding which products to buy and whether to buy them at all. The longer the payback time, the less desirable the product from an energy savings standpoint.

It is not uncommon for there to be ample insulation in an attic floor, with an R value of 30 or higher, and to have little or no insulation at the point where the pull-down stairs are installed. Not only is the insulation at that location often limited to the materials the staircase is made of, but there can be leakage of air around the staircase between the rooms below and the attic above. This problem has been addressed before, and there are a number of devices that cover the pull-down stairs to an attic to add insulation to the staircase. However, many of these are complicated affairs that are difficult to install or are expensive to manufacture, resulting in a disincentive to the busy homeowner because of a long payback time. Furthermore, the dominant characteristic of heat loss does not result from a lack of insulation in the attic near or over the stair case, but rather from air leaks to and from the attic. Therefore, the primary thrust of the present invention is its ability to provide an effective seal against drafts in a device having a very short payback time because of its exceptionally inexpensive, easy-to-install and convenient-to-ship system.

Known pull-down staircase covers are directed much more towards thermal insulation than leak insulation, and there are many different designs. For example, Edwards, in U.S. Pat. No. 4,151,894, teaches a box-like cover made of "wood, fiberglass or other suitable plastic" with a handle on the inside and a rubber gasket fixed to the lower edge of the cover to "sealingly engage the attic floor." An example of a compact attic staircase cover is found in Fuller's patent, U.S. Pat. No. 4,281,743, which breaks down into "nestable" parts for storage or shipping. The parts, preferably made of a foamed polymer such as polystyrene, have overlapping joints for better structural integrity.

Another simple cap-like cover is disclosed in U.S. Pat. No. 4,658,555 by Steiner. Steiner's cap is made of high R value materials, including a fiberglass "gasket" on the cap to seal it to the rough wood floor of the attic.

Helbig dimensions his enclosure to be shipped with the staircase, as taught by U.S. Pat. No. 4,312,423. However, in an alternative embodiment, he provides a second, redundant and larger enclosure over the first enclosure to cover the whole frame, not just the portion within the frame. The staircase cover designed by Daw, et al. in U.S. Pat. No. 4,832,153 has a compact storage arrangement of its various components, including two packaging pieces used simply to "shape" the overall set of components, all of which are made of fiberglass or rigid foam.

Some covers are attached at one side and rotate into a covering position. The simplest example is that disclosed by Waters, et al. in U.S. Pat. No. 4,344,505, who have a "door-like" hatch for a staircase made of expanded polystyrene. Another example of one of these is taught by Daley in U.S. Pat. No. 4,928,441. Daley also teaches the use of a sheet of sponge rubber attached to it that serves as a gasket between the upper part of the cover. Another example of a rotating dome-like cap for a pull-down staircase is seen in Mariano, et al., U.S. Pat. No. 4,550,543. Mariano, et al. teach the use of weather stripping adhered to the edge of a dome made of insulating material. Still another rotating cap for a staircase is provided by the teachings of Vesperman, et al. in U.S. Pat. No. 4,541,208 who set the sides of their fiberglass cover on rails, one of which permits limited rotation.

Characteristic of more elaborate closures is Hulligan's cover, described in U.S. Pat. No. 5,220,757. This enclosure remains in place during use of the staircase, but a flexible corrugated, plastic member pulls into position, in the manner of the cover of a roll-top desk, when the user wants to seal the attic. For other examples of more elaborate closures, see Sciambi, et al.'s closure in U.S. Pat. No. 4,591,022.

Finally, King teaches a zippered cover for an attic staircase in U.S. Pat. No. 4,337,602. His flexible cover is supported by posts along the sides.

All of the foregoing devices are designed to cover a pull-down staircase to prevent heat loss to the attic. Several also address drafts by applying a gasket or seal to the cover's edge that engages the attic floor or staircase frame. Most are either box-like or dome-like to accommodate the staircase when it is in the stored configuration. There are even some devices that address storage and shipping space. None, however, is made of a material that is thin enough to be folded into a truly compact shape for shipping and storage or applies the seal to the frame, rather than the edge of the cover. None has the economies that enables as rapid a payback as the present invention.

SUMMARY OF THE INVENTION

According to the major aspects of its preferred embodiment, the present invention comprises a cardboard flat that is die cut and foldable, a roll of weather stripping, and a set of plastic rivets. The cardboard flat is folded with the flaps on the outside to form a half box, that is, a base and four walls to serve as an enclosure for a pull-down staircase.

The flaps are secured to the outsides of the walls and secured by the plastic rivets to maintain the half-box shape. The weather stripping is applied to the framing around the fold-down door of the attic by pealing the paper from the adhesive-coated side of the stripping and adhering the stripping to the framing. The cardboard half-box is inverted and the edges rested on the stripping. Preferably, two or more nails are driven into the weatherstripping along the sides of the framing to serve as guides for positioning the cover on the weather stripping.

The use of weather stripping applied to the framing in combination with the edge of the cardboard box is a feature of the present invention. Weather stripping is made of a compressible open cell foam. The edge of the box, although light, can exert enough pressure to compress the foam under the edge. The balance of the uncompressed foam on either side of the edge seals against the edge. Furthermore, applying the weather stripping to the framing is much easier than trying to apply it to the edge of the cardboard, which is too thin to carry the weather stripping. By relegating this task to the homeowner, manufacturing is simplified.

The use of cardboard is another feature of the present invention. Cardboard has an R value of about 3, which is not high enough to be really effective as thermal insulation, but the material is effective against drafts, which are much more of an energy problem than loss of heat from radiation. Furthermore, by applying fiberglass insulation batting to its flat smooth top, the R value of the present draft insulator can be increased to the extent desired. The cardboard flat, however, can be easily and cheaply made and shipped in a tightly-folded configuration, with the weather stripping and rivets tucked inside of a shrink-wrapped package. Cardboard can have good compressive strength and can be printed with instructions or advertising, thus further simplifying the manufacturing and packaging of the product.

Other features and advantages will be apparent to those skilled in the art of home energy use and conservation from a careful reading of the Detailed Description of Preferred Embodiments, accompanied by the Drawings.

DETAILED DESCRIPTION OF PREFERRED EMBODIMENTS

The present invention is a draft insulator for use with an attic pull-down staircase. It is specifically designed to insulate against drafts and, by avoiding more expensive construction that has higher R value, to be extremely low in cost so that the consumer's payback time is less than one season. Furthermore, by simply affixing ordinary fiberglass batting on top of it, its R value can be increased to the extent desired.

The lower cost of the present invention comes from three factors: (1) a choice of very inexpensive materials, (2) a choice of materials that can be die cut and folded so that the shipper is not paying to ship as much "air" (i.e., more units shipped per unit volume) and (3) a transfer to the consumer of the tasks of partial assembly and installation to avoid those costs as part of manufacturing.

Referring now to the figures, the present invention includes at a minimum three components: a die cut and foldable flat, made of an inexpensive and thin material; a length of plastic foam weather stripping; and a set of plastic rivets (or other fasteners). In addition, these three components may also include two or more long finishing nails. The components cooperate to provide the present draft insulator in the form of a kit. The purposes of these components will now be described.

Figure 1:
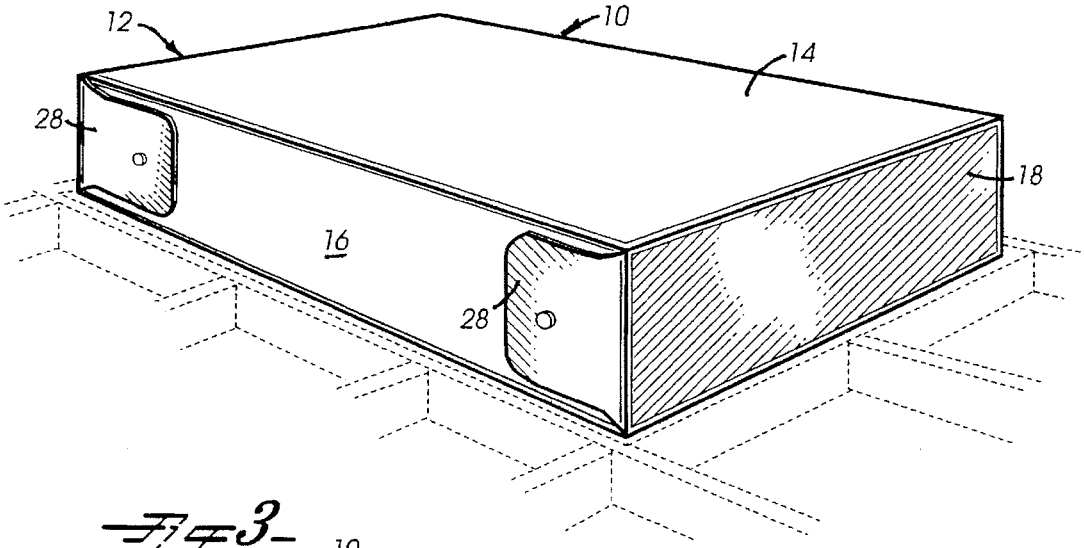
FIG. 1 is a perspective view of a draft insulator for a pull-down staircase, according to a prefected embodiment of the present invention.
Figure 3:
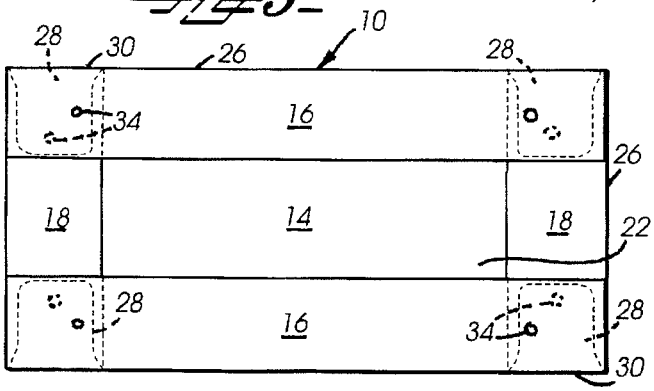
FIG. 3 is a plan view of the folded flat of the insulator shown in FIG. 2.
Figure 2:
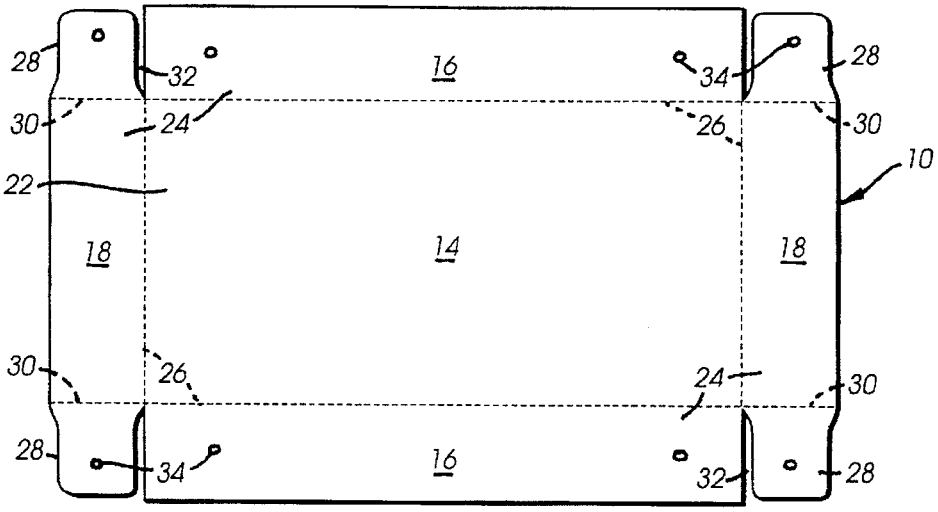
FIG. 2 is a plan view of the flat of the insulator before assembly, according to a preferred embodiment of the present invention.
Figure 5:
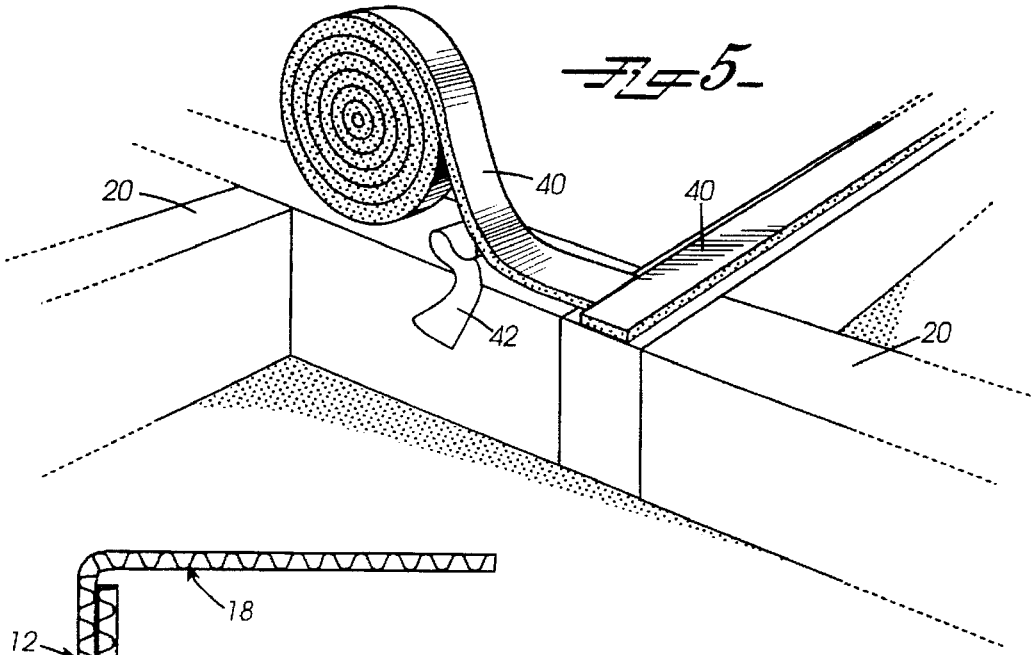
FIG. 5 is a detailed view of the installation of the weather stripping for the draft insulator, according to the present invention.

The flat is shown assembled in FIG. 1, unfolded in FIG. 2, and folded in FIG. 3. The flat, generally indicated by reference number 10, is made of a thin, inexpensive material such as ¼ inch thick cardboard. It should be thin enough to fold against itself easily without stressing along the old line. Alternatively, a thin, rigid foamed and bendable plastic may be used if comparable in price to cardboard. When folded and fastened, flat 10 is in the shape of a box 12 or "half box;" that is, it has a top 14 and four sides, two long sides 16 and two short sides 18, but no bottom. When inverted, it is dimensioned to receive the folded pull-down staircase and to cover the staircase when box 12 rests on the framing 20 (see FIG. 7) in the attic around the staircase. The unfolded flat 10 includes a large rectangular section 22 that becomes top 14; four integral rectangles 24 that become the four sides 16,18 when folded along lines 26; and four integral flaps 28 that secure the adjacent sides to the sides they are integrated with when they are folded along lines 30 and attached to those sides. Each flap 28 is shown as cut away near the adjacent side so that it does not interfere with folding. This cut away portion 32 is important not only to facilitate folding but also to prevent stress to the fold along lines 26.

There are several ways flat 10 can be folded. Preferably, flat 10 is folded as shown in FIG. 3, with flaps 28 folded against short sides 18 first, then short sides 18 are folded against top 14, and finally long sides 16 are folded against top 14. All edges of sides 16, 18 and flaps 28 are on the same side of top 14, leaving the other side of top 14 smooth and flat, suitable for carrying installation instructions, trademarks and advertising printed directly thereon. By applying the instructions and any other printing on one outer side rather than on multiple sides or printing these on separate stock, manufacturing costs are reduced. The remaining components, weather stripping, rivets and nails, can be bagged and tucked into the folds and the whole assembly shrink-wrapped for shipping and sales. The entire assembly may be only about one inch thick.

Figure 4:
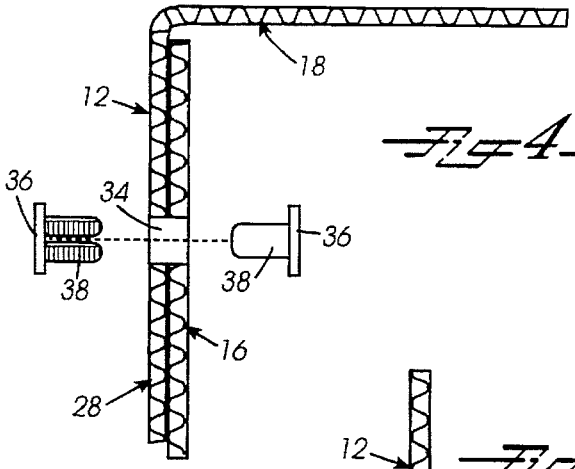
FIG. 4 is a detailed view of the assembly of the draft insulator shown in FIG. 1.
Figure 6:
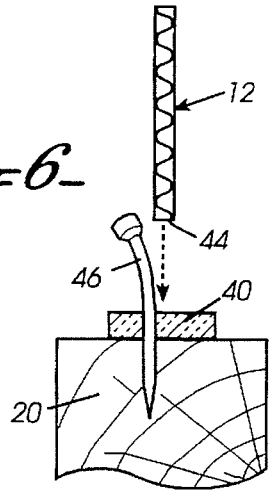
FIG. 6 is a detailed view of the installation of the draft insulator, shown being guided into position, according to the present invention.

To install, flat 10 is unfolded and then flaps 28 are placed preferably to the outside of long sides 16. Preformed holes 34 in long sides 16 and flaps 28 are aligned, and two plastic rivets 36 (see FIG. 4) are pushed together from opposites sides of the aligned holes 34, one from the inside and one from the outside, so that their legs 38 interleave. One pair of rivets 36 is believed to be sufficient. Other fastening mechanisms that can also be used include adhesives covered for shipping by a removable paper strip, hook and loop fasteners, clips, and tabs and slots. Again, the cost is the primary factor once a fastener is selected that provides sufficient holding power. Also, it will be clear that flaps 28 can be integral with long sides 16 and can be attached to the inside of the adjacent side as easily as the outside.

Next, the folded flat 10 or box 12 is inverted and temporarily placed on framing 20 of the attic floor over the staircase. The outline of the long and short sides 16, 18, of box 12 on framing 20 is traced with a pencil. Following that tracing, a length of weather stripping 40 is adhered to the framing. Weather stripping 40 preferably is supplied by a roll in sufficient length. The side of weather stripping 40 carrying an adhesive is covered with a removable layer of paper 42. The paper is pealed to expose the adhesive as the roll of weather stripping 40 is unrolled to apply it along the pencil line.

Figure 7:
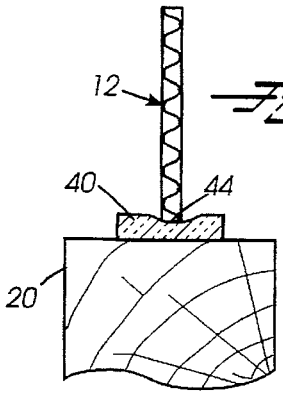
FIG. 7 is a detailed view of the draft insulator resting on the weather stripping, according to the present invention.

The edge 44 of box 12 is relatively thin, even with heavier grades of cardboard. Although edge 44 is too thin to have weather stripping attached to it, its thinness is used to advantage in the present invention because it applies a relatively larger amount of pressure to its resilient surface, here, the foam weather stripping 40, which compresses under the weight of box 12 on that thin edge 44. As a result and as shown in FIG. 7, the foam weather stripping compresses because of its resilience under the pressure of edge 44 but remains full and uncompressed on either side. Thus, entire edge 44 rides below the surface of weather stripping 40 for an effective seal. Also, because the consumer applies weather stripping 40 to framing 20 rather than having the manufacturer apply a seal to edge 44 of the present draft insulator, manufacturing costs are kept low.

In a preferred embodiment, at least one pair of finishing nails 46 are supplied with the draft insulator. These are driven into framing 20, through weather stripping 40 but just outside of its mid-point. Nails 46 are either driven in at an angle or bent outwardly after being driven straight in. Bent nails 46 serve as a simple guide for positioning box 12 and also serve to prevent long sides 16 from bowing.

It will be apparent to those skilled in the art that many changes and substitutions can be made to the preferred embodiments described above without departing from the spirit and scope of the present invention, which is defined by the following claims.

What is claimed is:

1. A device for use in an attic with a pull-down staircase, the staircase set within a frame, said device comprising:

an enclosure dimensioned to enclose the pull-down staircase, said enclosure having edges; and a resilient sealing strip attachable to the frame, said edges of said enclosure adapted to rest on and compress said sealing strip so that said sealing strip seals against said edges of said enclosure, said sealing strip being wider than said edges of said enclosure and said sealing strip adapted to support enclosure from said edges.

2. The device as recited in claim 1, wherein said sealing strip is a foamed plastic.

3. The device as recited in claim 1, wherein said sealing strip is coated with an adhesive to attach said strip to the frame by adhesion.

4. The device as recited in claim 1, wherein said sealing strip is foamed plastic coated with an adhesive to attach said strip to the frame by adhesion.

5. The device as recited in claim 1, wherein said enclosure is a cardboard flat, die cut for folding against itself.

6. The device as recited in claim 1, wherein said enclosure is a rigid plastic flat, die cut for folding against itself.

7. The device as recited in claim 1, wherein said enclosure is a flat, die cut to form sides and a bottom and foldable into a box, and wherein said device further comprises a set of rivets for fastening said sides together to form said box.

8. The device as recited in claim 1, wherein said enclosure is a cardboard flat, die cut to form sides and a bottom and foldable into a box, and wherein said device further comprises a set of rivets for fastening said sides together to form said box.

9. The device as recited in claim 1, wherein said enclosure is a flat, die cut for folding against itself and to form a box, and said sealing strip is foamed plastic.

10. A kit for use in an attic with a pull-down staircase, said kit for use in draft insulation of the staircase, the staircase enclosed within a frame, said kit comprising:

a flat made of cardboard that is die cut to define sides and a bottom for folding into an enclosure dimensioned to receive the staircase, said sides having edges;

a set of rivets for fastening said sides of said flat together; and a resilient strip for attaching to the frame, said edges of said enclosure adapted to compress said strip to seal against the frame, said strip adapted to support said enclosure and said strip being wider than said edges.

11. The kit as recited in claim 10, wherein said rivets are made of plastic.

12. The kit as recited in claim 10, wherein said resilient strip is made of foamed plastic.

13. The kit as recited in claim 10, wherein said resilient strip is made of foamed plastic and has an adhesive layer for attaching said strip to the frame.

14. The kit as recited in claim 10, further comprising a set of nails for use in forming guides for guiding said enclosure into position.

15. Apparatus for preventing drafts from an attic having a pull-down staircase, said apparatus comprising:

a die cut and foldable flat forming an enclosure dimensioned to receive said pull-down staircase, said enclosure having edges;

means for holding said foldable flat as a folded enclosure;

sealing means attachable to said frame for supporting and for engaging said edges and for sealing against said edges; and means for guiding said enclosure into position on the frame with said edges adapted to engage engaging said sealing means and said guiding means adapted to be positioned angularly through said sealing means.

16. The apparatus as recited in claim 15, wherein said sealing means is plastic foam with an adhesive layer for attachment to the frame.

17. The apparatus as recited in claim 15, wherein said flat is selected from the group consisting of cardboard and rigid, bendable plastic.

18. The apparatus as recited in claim 15, wherein said holding means further comprises plastic rivets to be used in pairs.

* * * * *